US007267620B2

(12) United States Patent
Chao et al.

(10) Patent No.: US 7,267,620 B2
(45) Date of Patent: Sep. 11, 2007

(54) GOLF CLUB HEAD

(75) Inventors: Bing-Ling Chao, San Diego, CA (US); Todd P. Beach, San Diego, CA (US); Jabaarr A. Flukers, Vista, CA (US); Citra A. Ie, San Diego, CA (US); Benoit Vincent, Leucadia, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 367 days.

(21) Appl. No.: 10/442,348

(22) Filed: May 21, 2003

(65) Prior Publication Data

US 2004/0235584 A1 Nov. 25, 2004

(51) Int. Cl.
*A63B 53/04* (2006.01)

(52) U.S. Cl. ..... 473/342; 473/348

(58) Field of Classification Search ..... 473/324, 473/329, 330, 342, 345, 347, 349
See application file for complete search history.

(56) References Cited

U.S. PATENT DOCUMENTS 3,836,153 A * 9/1974 Dance, Jr. ..... 473/342
3,937,474 A * 2/1976 Jepson et al. ..... 473/342
4,398,965 A * 8/1983 Campau ..... 148/522
4,618,149 A 10/1986 Maxel
4,793,616 A 12/1988 Fernandez
4,809,978 A * 3/1989 Yamaguchi et al. ..... 473/329
4,884,812 A * 12/1989 Nagasaki et al. ..... 473/342
4,995,609 A * 2/1991 Parente et al. ..... 473/314
5,078,397 A * 1/1992 Aizawa ..... 473/342
5,271,621 A 12/1993 Lo
5,310,185 A 5/1994 Viollaz et al.
5,312,106 A 5/1994 Cook
5,377,986 A 1/1995 Viollaz et al.
5,417,419 A 5/1995 Anderson et al.
5,425,538 A 6/1995 Vincent et al.
5,472,201 A * 12/1995 Aizawa et al. ..... 473/329
5,672,120 A 9/1997 Ramirez et al.

(Continued)

FOREIGN PATENT DOCUMENTS

GB 1 201 648 8/1970

(Continued)

OTHER PUBLICATIONS

Taylor Made '94/'95 Products—Mid Tour; Mid Tour GF.

*Primary Examiner*—Eugene Kim
*Assistant Examiner*—Alvin A Hunter
(74) *Attorney, Agent, or Firm*—Sheppard, Mullin, Richter & Hampton LLP

(57) ABSTRACT

A golf club head comprising a body and a face insert is provided. The body defines a front opening, and the face insert is attached at and closes the front opening. The face insert comprises prepreg plies having a fiber areal weight of less than 100 g/m$^2$. The face insert further includes a layer of textured film that is co-cured with the prepreg plies to form a front surface of the face insert. The face insert may alternatively include a metallic cap on the front surface of the face insert instead of the layer of textured film. The face insert's total thickness is within a range of about 1 mm to about 8 mm.

9 Claims, 5 Drawing Sheets

U.S. PATENT DOCUMENTS

| | | | | |
|---|---|---|---|---|
| 5,743,813 | A | 4/1998 | Chen et al. | 473/329 |
| 5,827,131 | A | 10/1998 | Mahaffey et al. | 473/342 |
| 5,967,903 | A | 10/1999 | Cheng | 473/342 |
| 5,985,197 | A | 11/1999 | Nelson et al. | 264/221 |
| 6,071,200 | A | 6/2000 | Song | 473/345 |
| 6,165,081 | A * | 12/2000 | Chou | 473/329 |
| 6,248,024 | B1 | 6/2001 | Nelson et al. | 473/324 |
| 6,248,025 | B1 * | 6/2001 | Murphy et al. | 473/324 |
| 6,299,547 | B1 * | 10/2001 | Kosmatka | 473/329 |
| 6,338,683 | B1 * | 1/2002 | Kosmatka | 473/329 |
| 6,354,962 | B1 * | 3/2002 | Galloway et al. | 473/342 |
| 6,364,789 | B1 * | 4/2002 | Kosmatka | 473/329 |
| 6,406,378 | B1 | 6/2002 | Murphy et al. | 473/224 |
| 6,406,381 | B2 | 6/2002 | Murphy et al. | 473/345 |
| 6,435,980 | B1 | 8/2002 | Reyes et al. | 473/324 |
| 6,440,008 | B2 | 8/2002 | Murphy et al. | 473/324 |
| 6,669,577 | B1 * | 12/2003 | Hocknell et al. | 473/329 |
| 7,189,165 | B2 * | 3/2007 | Yamamoto | 473/248 |
| 2002/0169034 | A1 | 11/2002 | Hocknell et al. | 473/329 |

FOREIGN PATENT DOCUMENTS

| | | |
|---|---|---|
| JP | 60-15145 | 1/1985 |
| JP | 6-23071 | 2/1994 |
| JP | 06-165842 | 6/1994 |
| JP | 6-205858 | 7/1994 |
| JP | 09-176347 | 7/1997 |
| JP | 11-137734 | 5/1999 |

* cited by examiner

GOLF CLUB HEAD

BACKGROUND OF THE INVENTION

The present invention relates generally to golf club heads and, more particularly, to a wood-type golf club head having a composite face insert.

Composite materials have long been recognized for combining many beneficial attributes of various types and are commonly used in golf club heads. Composite materials typically are less dense than other materials used in golf clubs. Thus, the use of composite materials allows for more leeway in how weight is distributed about the club. It is often desirable to locate club weight away from the striking face. Thus, attempts have been made to incorporate composite materials in the club face.

Although such attempts have been generally effective for weight reduction purposes, a number of shortfalls remain, such as durability, impact resistance and overall club performance. For example, prior composite club faces have often suffered from delamination, or peeling apart, of composite layers, greatly reducing the useable life of the club. Delamination is particularly a problem at interface regions between the composite material and other materials of the club head. Such problems have arisen even at relatively low impact levels, hit counts and in benign playing conditions. Attempts to resolve such problems often fail to provide satisfactory club performance, measured by factors such as coefficient of restitution (COR), particularly for wood-type club heads having a volume of at least 300 cc.

It should, therefore, be appreciated that there exists a need for a wood-type golf club head having composite material at the club face that is durable, can endure high level impacts and yet provide superior club performance. The present invention fulfills this need and others.

SUMMARY OF THE INVENTION

The invention provides a golf club head having a lightweight face insert attached to a body that is at least partly formed of a metallic material, providing superior durability and club performance. To that end, the face insert comprises prepreg plies having a fiber areal weight (FAW) of less than 100 g/m$^2$. The body preferably forms a volume of at least 200 cc. The face insert preferably has a thickness within a range of about 1 mm to about 8 mm. The coefficient of restitution for the club head, measured in accordance to the United States Golf Association Rule 4-1a, is at least 0.79.

In a preferred embodiment of the invention, the face insert further includes a cap that is attached to a front surface of the composite region. Also preferably, the thickness of the composite region is about 4.5 mm or less and the metallic cap thickness is about 0.5 mm or less; more preferably the thickness of the composite region is about 3.5 mm or less and the metallic cap thickness is about 0.3 mm or less. The cap preferably comprises a titanium alloy. The face insert may alternatively comprise a layer of textured film co-cured with the plies of low FAW material, in which the layer of textured film forms a front surface of the face insert instead of the metallic cap. The layer of textured film preferably comprises nylon fabric.

For purposes of summarizing the invention and the advantages achieved over the prior art, certain advantages of the invention have been described above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
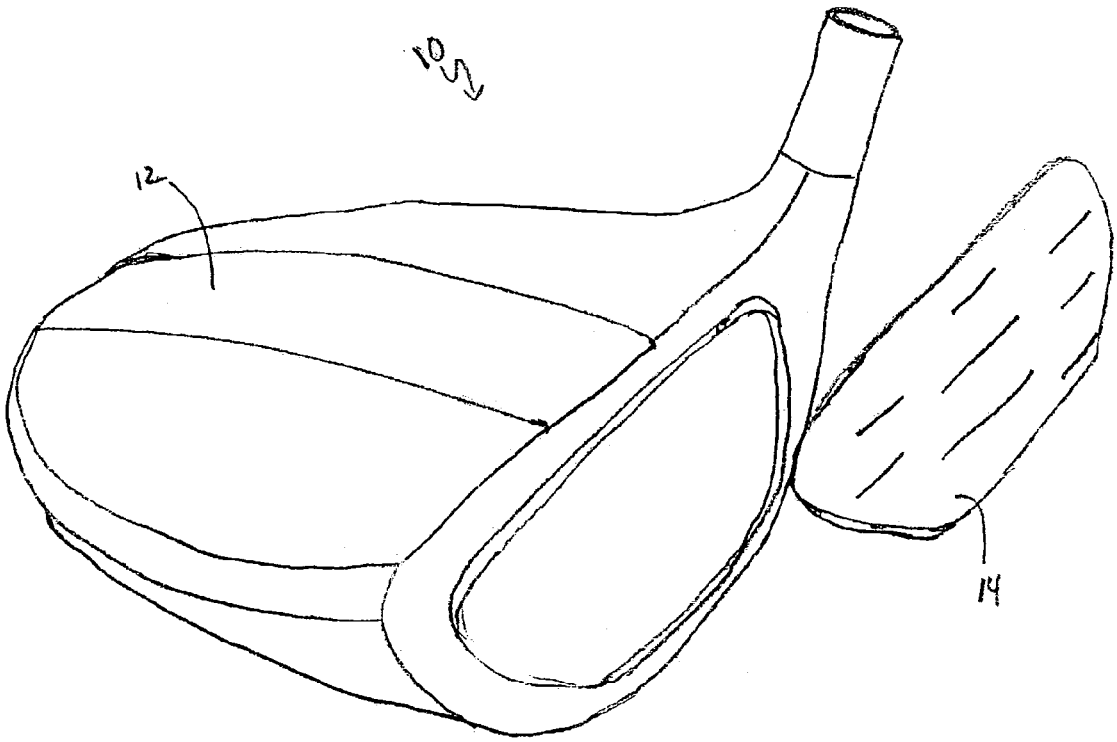
FIG. 1 is an exploded view of a club head in accordance with the invention, depicting a composite face insert and a metallic body.
Figure 2:
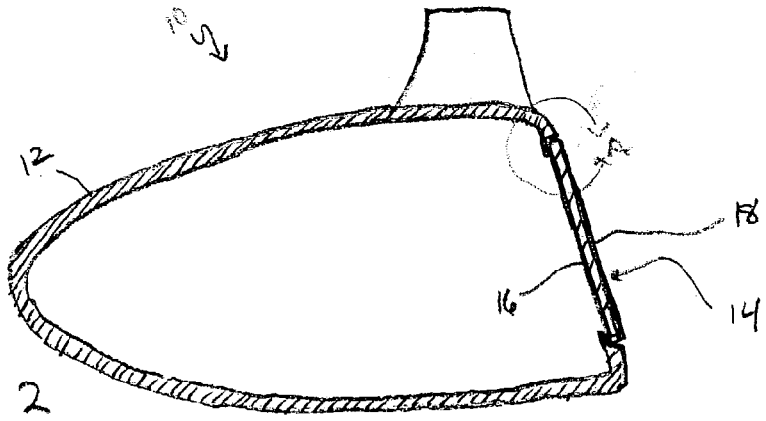
FIG. 2 is a cross-sectional view of the club head of FIG. 1.

With reference to the illustrative drawings, and particularly FIGS. 1 and 2, there is shown a golf club head 10 having a metallic body 12 and a face insert 14 comprising a composite region 16 and a metallic cap 18. The face insert 14 is durable and yet lightweight. As a result, weight can be allocated to other areas of the club head 10, enabling the 'dub head's center of gravity to be desirably located farther from the sinking face 40 and to further enhance the club head's moment of inertia. The body 12 includes an annular ledge 32 for supporting the face insert 14. In a preferred embodiment, the body 12 is fanned by investment casting a titanium alloy. With the face insert 14 in place, the club head 10 preferably defines a volume of at least 200 cc and more preferably a volume of at least 300 cc. The club head 10 has superior durability and club performance, including a coefficient of restitution (COR) of at least 0.79.

Figure 3:
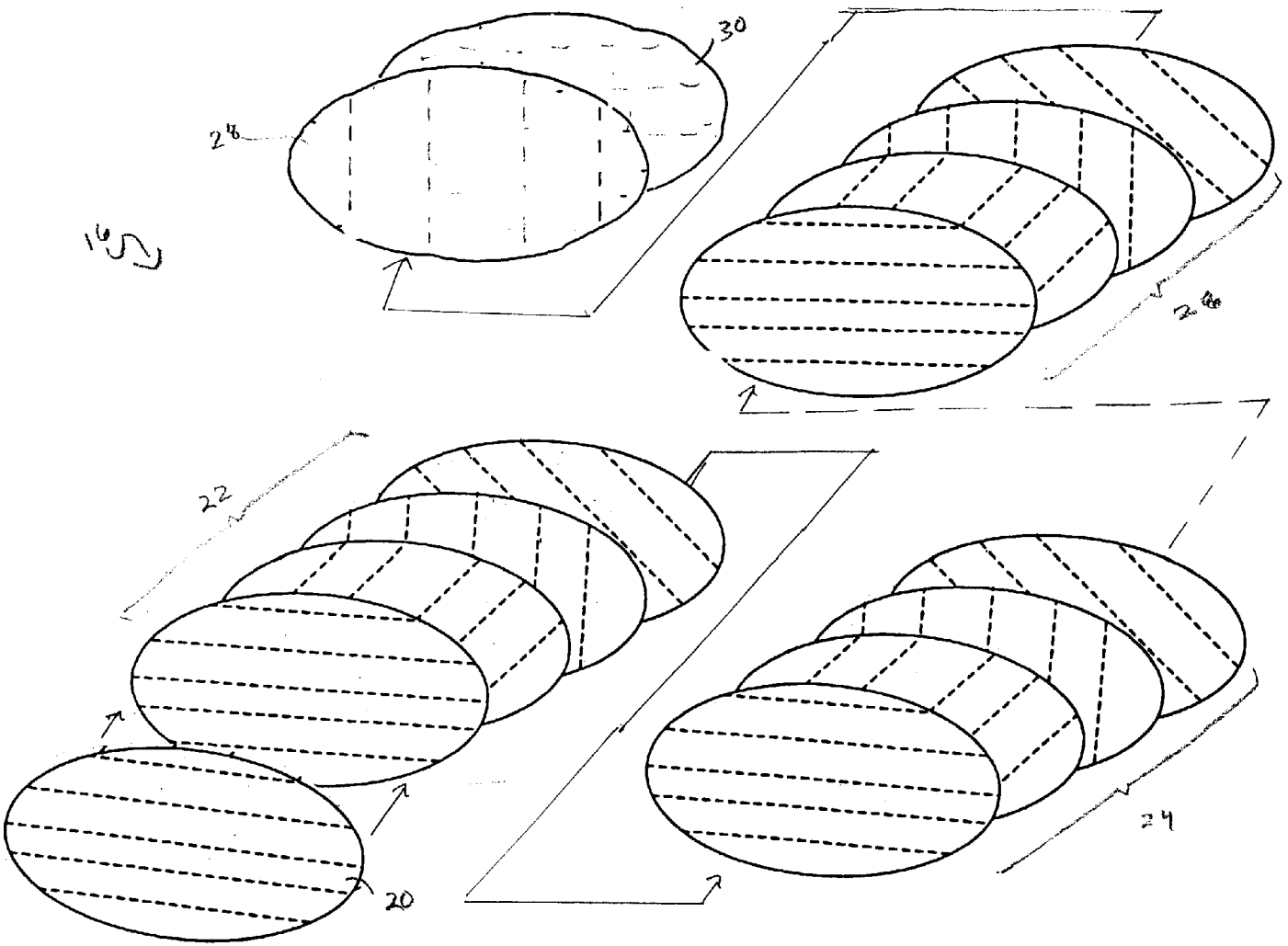
FIG. 3 is an exploded view of the composite region of the face insert of FIG. 1 showing the plies Comprising the composite region.

With reference to FIG. 3, the composite region 16 of the face insert 14 is configured to have a relatively consistent distribution of reinforcement fibers across a cross section of its thickness to facilitate efficient distribution of impact forces and overall durability. The composite region 16 includes prepreg plies, each ply having a fiber reinforcement and a resin matrix selected to contribute to the club's durability and overall performance. Tests have demonstrated that composite regions formed of prepreg plies having a relatively low fiber areal weight (FAW) provide superior attributes in several areas, such as, impact resistance, durability and overall club performance. More particularly, FAW values below 100 g/m$^2$, or preferably 70 g/m$^2$ or more preferably 50 g/m2, are considered to be particularly effective. Several prepreg plies having a low FAW can be stacked and still have a relatively uniform distribution of fiber across the thickness of the stacked plies. In contrast, at comparable resin content (R/C) levels, stacked plies of prepreg materials having a higher FAW tend to have more significant resin rich regions, particularly at the interfaces of adjacent plies, than stacked plies of lower FAW materials. It is believed that resin rich regions tend to inhibit the efficacy of the fiber reinforcement, particularly since the force resulting from golf ball impact is generally transverse to the orientation of the fibers of the fiber reinforcement. Preferred methods of manufacturing, which aid in reducing resin rich regions, are discussed in detail further below.

Due to the efficiency of prepreg plies of low FAW, the face insert 14 can be relatively thin, preferably less than about 4.5 mm and more preferably less than about 3.5 mm. Thus, use of the face insert 14 results in weight savings of about 10 g to 15 g over a comparable volume of metal used in the body 12 (e.g., Ti-6A1-4V). As mentioned above, this weight can be allocated to other areas of the club, as desired. Moreover, the club head 10 has demonstrated both superior durability and performance. In a durability test, the club head 10 survived over 3000 impacts of a golf ball shot at a velocity of about 44 m/sec. In a performance test of the club's COR, measured in accordance with the United States Golf Association Rule 4-1a, the club bead had a COR of about 0.828.

With continued reference to FIG. 3, each prepreg ply of the composite region 16 preferably has a quasi-isotropic fiber reinforcement, and the plies are stacked in a prescribed order and orientation. For convenience of reference, the orientation of the plies is measured from a horizontal axis of the club head's face plane to a line aligned with the fiber orientation of each ply. A first ply 20 of the composite region 16 is oriented at 0 degrees, followed by ten to twelve groups of plies (22, 24, 26) each having four plies oriented at 0, +45, 90 and −45 degrees, respectively. Thereafter, a ply 28 oriented at 90 degrees precedes the final or innermost ply 30 oriented at 0 degrees. In this embodiment, first and final plies are formed of a prepreg material reinforced by glass fibers, such as 1080 glass fibers. The remaining plies are formed of prepreg material reinforced by carbon fiber.

A suitable carbon fiber reinforcement comprises a carbon fiber known as "34-700" fiber, available from Grafil, Inc., of Sacramento, Calif., which has a tensile modulus of 234 Gpa (34 Msi) and tensile strength of 4500 Mpa (650 Ksi). Another suitable fiber, also available from Grafil, Inc., is a carbon fiber known as "TR50S" fiber which has a tensile modulus of 240 Gpa (35 Msi) and tensile strength of 4900 Mpa (710 Ksi). Suitable epoxy resins known as Newport 301 and 350 are available from Newport Adhesives & Composites, Inc., of Irvine, Calif.

In a preferred embodiment, the composite region 16 includes prepreg sheets having a quasi-isotropic fiber reinforcement of 34-700 fiber having an areal weight of about 70 g/m$^2$ and impregnated with an epoxy resin (e.g., Newport 301) resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%. In a durability test, several plies of this material were configured in a composite region 16 having a thickness of about 3.7 mm. The resulting composite region 16 survived over 3000 impacts of a golf ball shot at a velocity of about 44 m/sec. In another preferred embodiment, the composite region 16 comprises prepreg plies of 50 FAW TR50S/350. This material was tested in a composite region 16 having a thickness of about 3.7 mm and it too survived a similar durability test.

Figure 4:
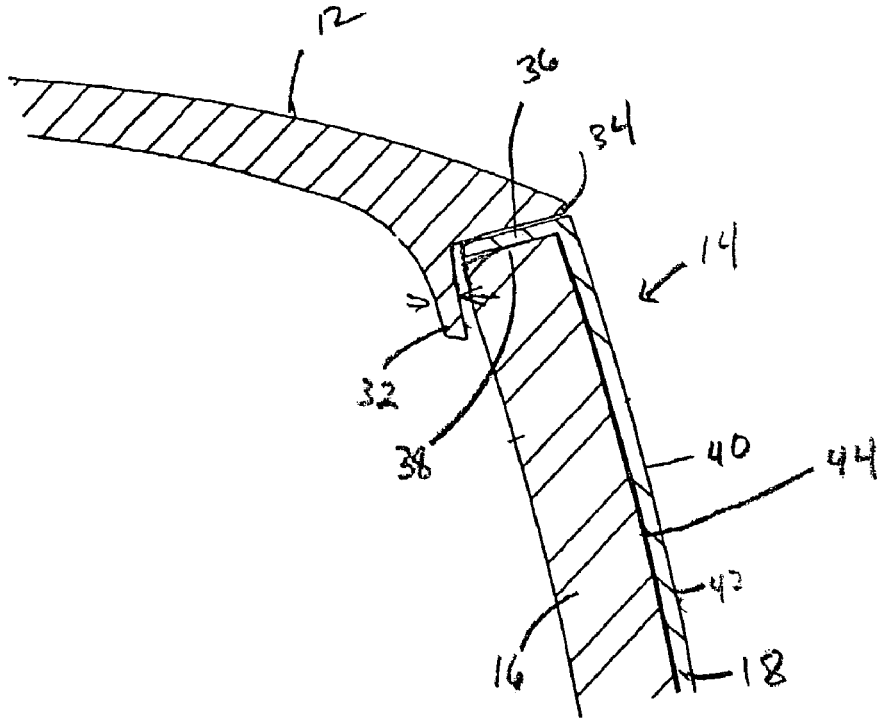
FIG. 4 is a close-up view of area A-A of the club head of FIG. 2, depicting a junction of the composite face insert and the body portion.

With reference to FIG. 4, the face insert 14 has sufficient structural strength that excessive reinforcement along the interface of the body 12 and the face insert 14 is not required, which further enhances beneficial weight allocation effects. In this embodiment, the body 12 is formed of a titanium alloy, Ti-6A1-4V; however, other suitable material can be used. The face insert 14 is supported by an annular ledge 32 and is secured preferably with an adhesive. The annular ledge 32 preferably has a thickness of about 1.5 mm and extends inwardly between about 3 mm to about 6 mm. The annular ledge 32 is sufficiently recessed to allow the face insert 14 to sit generally flush with a transition edge 34 of the body. Although, in this embodiment, the annular ledge 32 extends around the periphery of the front opening, it will be appreciated that other embodiments can utilize a plurality of spaced annular ledges, e.g., a plurality of tabs, to support the face insert 14.

With continued reference to FIG. 4, the metallic cap 18 of the face insert 14 includes a rim 36 about the periphery of the composite region 16. In a preferred embodiment, the metallic can 18 may be attached to a front surface of the face insert 14, wherein the combined thickness of the prepeg plies of the face insert 14 and the metallic cap 18 are no mater than the depth D of the annular ledge 32 at the front opening of the body 12. The rim 36 covers a side edge 38 of the composite region 16 to further protect against peeling and delamination of the plies. Preferably, the rim 36 has a height substantially the same as the thickness of the face insert 14. In an alternative embodiment, the rim 36 may comprise a series of segments instead of a continuous cover over the side edge 38 of the composite region 16. The metallic cap 18 and rim 36 may be formed, for example, by stamping or other methods known to those skilled in the art. A preferred thickness of the metallic cap 18 is less than about 0.5 mm, and more preferably, it is less than about 0.3 mm. However, in embodiments having a face insert 14 without a metallic cap 18, weight savings of about 15 g can be realized.

Preferably, the thickness of the composite region 16 is about 4.5 mm or less and the thickness of the metallic 18 is about 0.5 mm or less. More preferably the thickness of the composite region 16 is about 3.5 mm or less and the thickness of the metallic cap 18 is about 0.3 mm or less. The metallic cap preferably comprises a titanium alloy.

The metallic cap 18 defines a striking face 40 having a pirality of grooves 42. The metallic cap 18 further aids in resisting wear from repeated impacts with golf balls even when covered with sand. Preferably, a bond gap 44 of about 0.05 mm to 0.2 mm, and more preferably about 0.1 mm, is provided for adhesive attachment of the metallic cap 18 to the composite region 16. In an alternative embodiment, the bond gap 44 may be no greater than 0.2 mm. The metallic cap 18 is preferably fainted of Ti-6Al-4V titanium alloy; however, other titanium alloys or other materials having suitable characteristics can be employed. For example, a non-metallic cap, such as a cap comprising injection-molded plastic, having a density less than 5 g/cc and a hardness value of 80 Shore D may be employed.

Composite Material Process

As mentioned above, it is beneficial to have a composite region 14 that is relatively free of resin rich regions. To that end, fiber reinforcement sheets are impregnated with a controlled amount of resin to achieve a prescribed resin content. This is realized, in part, through management of the timing and environment in which the fiber sheets are cured and soaked.

Prior to curing, plies of fiber sheets are cut and formed to a desired shape, bulge and roll. The plies are stacked in prescribed orientations (e.g. FIG. 3). It is not necessary to cut all of the plies together. For example, groups of four plies (FIG. 3) can be cut and, thereafter, stacked to form the final thickness. The desired shape is achieved through cutting, such as, die cutting. The desired bulged and roll is achieved through debulking, i.e., compaction. During debulking, the plies are compressed together to reduce air trapped between plies. Compression or compaction for about two minutes per step has been found to be effective.

The plies can be cut at least twice before achieving the desired dimensions. A preferred approach includes cutting plies to a first size and debulking the plies in two compression steps of about two minutes each. Thereafter, the plies are die cut to the desired shape, and compressed a third time using a panel conformed to the desired bulge and roll. The plies are then stacked to a final thickness and compressed a fourth time with the conformed panel for about three minutes. The weight and thickness of the plies are measured preferably prior to the curing step.

Figure 5:
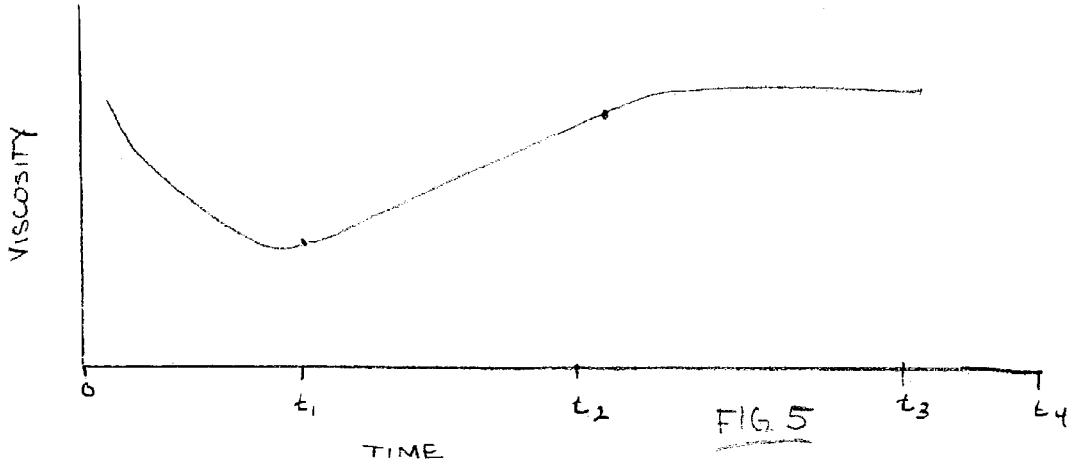
FIG. 5 is a graph depicting resin viscosity over time during the soaking and curing phases for a preferred method of forming the composite portion of the face insert of FIG. 1.
Figure 6:
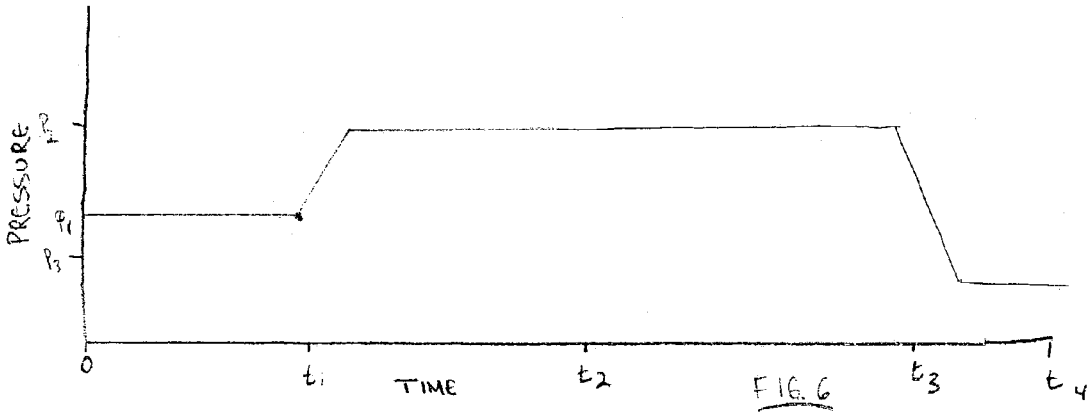
FIG. 6 is a graph depicting pressure over time during the soaking and curing phases of forming the composite portion of the face insert, corresponding to FIG. 5.
Figure 7:
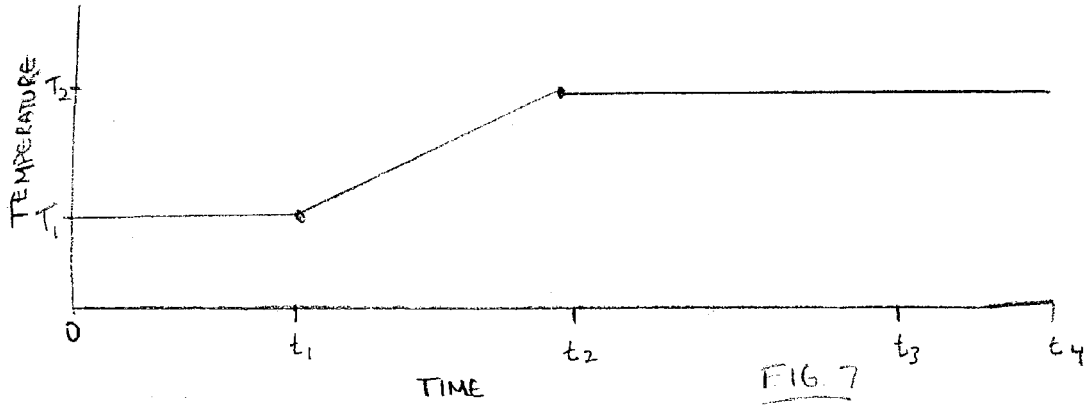
FIG. 7 is a graph depicting temperature over time during the soaking and curing phases of Conning the composite portion of the insert, corresponding to FIG. 5.

FIGS. 5-7 depict an effective soaking and curing profile for impregnating plies 70 FAW 34(700 fiber sheet with Newport 301 resin. Soaking and curing occurs in a tool having upper and lower plates. The tool is pre-layered with a mold release to facilitate removal of the composite material and is pre-heated to an initial temperature ($T_1$) of about 200° F. The initial soak period is for about 5 minutes, from $t_0$ to $t_1$. During the soak phase, the temperature and pressure remain relatively constant. The pressure ($P_1$) is at about 15 psi.

Then, a first cure phase of about 15 minutes commences, from $t_1$ to $t_2$, during which the pressure climbs to about 200 psi ($P_2$) and the temperature climbs to about 270° F. ($T_2$). Once the temperature reaches about 270° F. (at $t_2$), a post cure phase begins. The temperature is maintained for about 30 minutes. A final soaking/curing cycle is performed at a pressure ($P_3$) of 20 psi for 5 minutes. The final resin content is about 37.5%. Over a total time, three different pressure levels are achieved in a timed manner with two different temperature levels. For other composites, the temperature and pressures may vary with their associate soaking times.

Figure 8:
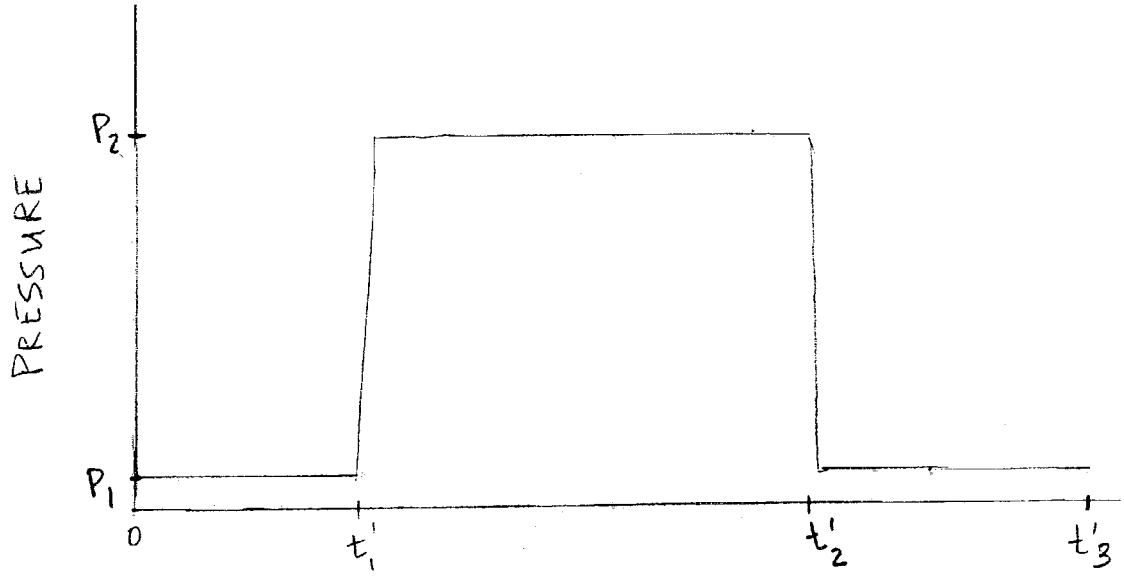
FIG. 8 is a graph depicting pressure over time during the soaking and curing phases of an alternative method of forming the composite portion of the insert of FIG. 1.
Figure 9:
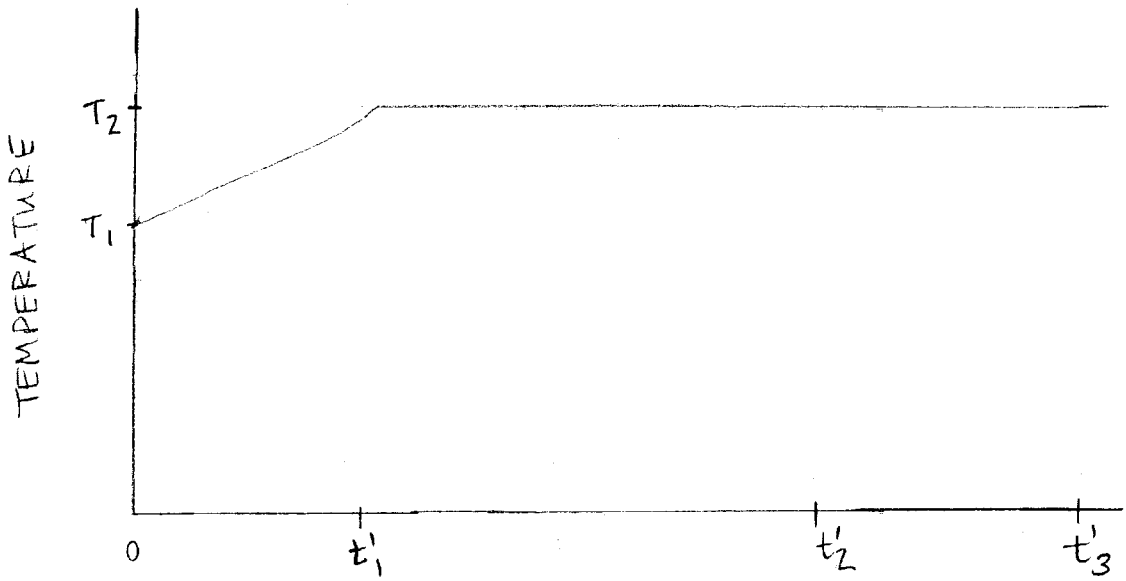
FIG. 9 is a graph depicting temperature over time during the soaking and curing phases of forming the composite portion of the insert, corresponding to FIG. 8.

An alternative soaking and curing profile is depicted in FIGS. 8 and 9. In this process, the temperature of the tool is initially about 200° F. ($T_1$) and upon placement of the composite material into the tool, the temperature is increased to about 270° F. ($T_2$). The temperature is then kept constant. The initial pressure ($P_1$) is about 20 psi. The initial soak period is for about 5 minutes, from to (0 sec.) to $t'_1$. The pressure is then ramped up to about 200 psi ($P_2$). The post cure phase lasts about 15 minutes ($t'_1$ to $t'_2$) and a final soaking/curing cycle is performed at a pressure ($P_1$) of 20 psi for 20 minutes ($t'_2$ to $t'_3$).

Composite Face Roughness Treatment

In order to increase the surface roughness of the composite region 16 and to enhance bonding of adhesives used therewith, a layer of textured film can be placed on the composite material before curing. An example of the textured film is ordinary nylon fabric. Curing conditions do not degrade the fabric and an imprint of the fabric texture is transferred to the composite surface. Tests have shown that adhesion of urethane and epoxy, such as 3M® DP460, to a composite surface treated in such a fashion was greatly improved and superior to adhesion to a metallic surface, such as cast titanium alloy.

A face insert 14 having increased surface roughness may comprise a layer of textured film co-cured with the plies of low FAW material, in which the layer of textured film forms a front surface of the face insert 14 instead of the metallic can 18. The layer of textured film preferably comprises nylon fabric. Without the metallic cap 18, the mass of the face insert 14 is at least 15 grams less than a Lice insert of equivalent volume formed of the metallic material of the body 12 of the club head 10.

Typically, adhesion of the 3M® DP460 adhesive to a cast metallic surface is greater than to an untreated composite surface. Consequently, when the face structure fails on impact, the adhesive peels off the composite surface but remains bonded to the metallic surface. After treating a composite surface as described above the situation is reversed and the 3M® DP460 peels off the metallic surface but remains bonded to the composite surface.

The enhanced adhesion properties of this treatment contribute to an improved fatigue life for a composite golf club face. In a test, a club head having an untreated face insert 14 and a COR of about 0.847 endured about 250 test shots before significant degradation or failure occurred. In contrast, a similar club head having a treated face insert 14 and a COR of about 0.842 endured over 2000 shots before significant degradation or failure occurred.

Alternatively, the means for applying the composite texture improvement may be incorporated into the mold surface. By doing so, the textured area can be more precisely controlled. For simple face plate joining to the opening of a cast body, the texture can be formed in surfaces where shear and peel are the dominant modes of failure.

It should be appreciated from the foregoing that the present invention provides a club head 10 having a composite face insert 14 attached to a metallic body 12, forming a volume of at least 200 cc and providing superior durability and club performance. To that end, the face insert 14 comprises prepreg plies having a fiber areal weight (FAW) of less than 100 $\mu g/m^2$. The face insert 14 preferably has a thickness less than 5 mm and has a mass at least 10 grams less than a face insert of equivalent volume formed of the metallic material of the body 12 of the club head 10. The coefficient of restitution for the club head 10 is preferably at least 0.79.

Alternatively, the face insert 14 may comprise any non-metallic material having a density less than a metallic material of the body 12 along with a metallic cap 18 covering a front surface of the face insert 14 and having a rim 36. For example, the face insert 14 of the present invention may comprise a composite material, such as a fiber-reinforced plastic or a chopped-fiber compound (e.g., bulk molded compound or sheet molded compound), or an injection-molded polymer either alone or in combination with prepreg plies having low FAW. The thickness of the face insert 14 may be substantially constant or it may comprise a variation of at least two thicknesses, one being measured at a geometric center and anoter measured near a periphery of the face insert 14. In one embodiment, for example, an injection-molded polymer disk may be embedded in a central region of a plurality of low FAW prepreg plies. The total thickness of the face insert 14 may range between about 1 mm and about 8 mm, preferably between about 2 mm and about 7 mm, more preferably between about 2.5 mm and about 4 mm, and most preferably between about 3 mm and about 4 mm.

In addition, the body 12 of a club head 10 in the present invention may be formed of a metallic material, a non-metallic material or a combination of materials, such as a steel skin and sole with a composite crown, for example. Also, one or more weights may be located in or on the body 12, as desired, to achieve final performance characteristics for the club head 10.

Although the invention has been disclosed in detail with reference only to the preferred embodiments, those skilled in the art will appreciate that additional golf club heads and related methods for manufacturing can be included without departing from the scope of the invention. Accordingly, the invention is defined only by the claims set forth below.

We claim:

1. A golf club head having a volume of at least 200 cc, comprising:

a body having a crown, a skirt, and a sole, the body defining a front opening;

a face insert having at least a portion comprising prepreg plies having a fiber areal weight of less than 100 g/m$^2$, the face insert closing the front opening of the body; and a metallic cap adhesively attached to the prepreg plies;

wherein the face insert's total thickness is within a range of about 1 mm to about 8 mm, the golf club head having a coefficient of restitution of at least 0.79; and wherein the thickness of the prepreg plies is about 3.5 mm or less and the metallic cap's thickness is about 0.5 mm or less.

2. A golf club head having a volume of at least 200 cc, comprising:

a body having a crown, a skirt, and a sole the body defining a front opening;

a face insert having at least a portion comprising prepreg plies having a fiber areal weight of less than 100 g/m$^2$, the face insert closing the front opening of the body; and a layer of textured film co-cured with the prepreg plies, the layer of textured film thereby forming a front surface of the face insert;

wherein the face insert's total thickness is within a range of about 1 mm to about 8 mm, the golf club head having a coefficient of restitution of at least 0.79.

3. A golf club head as defined in claim 2, wherein the layer of textured film comprises nylon fabric.

4. A golf club head comprising:

a body defining a front opening;

a face insert comprising prepreg plies having a fiber areal weight of less than 100 g/m$^2$, the face insert attached at and closing the front opening of the body; and a layer of textured film co-cured with the prepreg plies, the layer of textured film forming a front surface of the face insert;

wherein the face insert's total thickness is within a range of about 1 mm to about 8 mm.

5. The golf club head of claim 4, wherein the layer of textured film comprises nylon fabric.

6. A golf club head, comprising:

a body defining a front opening;

a face insert comprising a front surface, a side edge, and prepreg plies having a fiber areal weight of less than 100 g/m$^2$, the face insert attached at and closing the front opening of the body; and a cap covering at least a portion of the face insert and extending across a substantial portion of the front surface;

wherein the face insert's total thickness is within a range of about 1 mm to about 8 mm.

7. A golf club head, comprising:

a body defining a front opening;

a face insert comprising a front surface, a side edge, and prepreg plies having a fiber areal weight of less than 100 g/m$^2$, the face insert attached at and closing the front opening of the body; and a cap covering at least a portion of the face insert and extending across at least a portion of the front surface;

wherein the face insert's total thickness is within a range of about 1 mm to about 8 mm; and wherein the cap is comprised of a metallic material and has a thickness of less than 0.5 mm.

8. A golf club head, comprising:

a body defining a front opening;

a face insert comprising a front surface, a side edge, and prepreg plies having a fiber areal weight of less than 100 g/m$^2$, the face insert attached at and closing the front opening of the body; and a cap covering at least a portion of the face insert and extending across at least a portion of the front surface;

wherein the face insert's total thickness is within a range of about 1 mm to about 8 mm; and wherein the cap is comprised of a metallic material and has a thickness of less than 0.3 mm.

9. A golf club head, comprising:

a body defining a front opening and comprising an annular ledge extending around a periphery of the front opening; and a face insert comprising prepreg plies having a fiber areal weight of less than 100 g/m$^2$, the face insert coupled to the annular ledge and closing the front opening of the body;

wherein the annular ledge has a width extending towards the center of the front opening, and wherein the width is within a range of about 3 mm to about 6 mm; and wherein the face insert's total thickness is within a range of about 1 mm to about 8 mm.

* * * * *

UNITED STATES PATENT AND TRADEMARK OFFICE

CERTIFICATE OF CORRECTION

PATENT NO. : 7,267,620 B2
APPLICATION NO. : 10/442348
DATED : September 11, 2007
INVENTOR(S) : Bing-Ling Chao et al.

It is certified that error appears in the above-identified patent and that said Letters Patent is hereby corrected as shown below:

At column 2, line 25, "Comprising" should be -- comprising --.
2, line 38, "Conning" should be -- forming --.
2, line 56, "dub" should be -- club --.
2, line 57, "sinking" should be -- striking --.
2, line 60, "fanned" should be -- formed --.

At column 3, line 38, "bead" should be -- head --.
3, line 50, after "embodiment," insert -- the --.

At column 4, line 36, "can" should be -- cap --.
4, line 37, "prepeg" should be -- prepreg --.
4, line 39, "mater" should be -- greater --.
4, line 55, after "metallic" insert -- cap --.
4, line 61, "pirality" should be -- plurality --.

At column 5, line 1, "fainted" should be -- formed --.
5, line 10, "14" should be -- 16 --.

At column 6, line 21, "can" should be -- cap --.
6, line 23, "Lice" should be -- face --.

At column 7, line 5, "anoter" should be -- another --.
7, line 17, "skin" should be -- skirt --.

Signed and Sealed this

Thirteenth Day of May, 2008

JON W. DUDAS
*Director of the United States Patent and Trademark Office*